US008659525B2

(12) United States Patent
Thiebaud et al.

(10) Patent No.: US 8,659,525 B2
(45) **Date of Patent: *Feb. 25, 2014**

(54) METHOD OF DRIVING A DISPLAY PANEL WITH DEPOLARIZATION

(71) Applicant: Thomson Licensing, Issy de Moulineaux (FR)

(72) Inventors: Sylvain Thiebaud, Noyal sur Vilaine (FR); Jean-Paul Dagois, Cesson Sevigne (FR); Philippe Le Roy, Betton (FR)

(73) Assignee: Thomson Licensing, Issy les Moulineaux (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/836,949

(22) Filed: Mar. 15, 2013

(65) Prior Publication Data

US 2013/0201089 A1 Aug. 8, 2013

Related U.S. Application Data

(62) Division of application No. 12/086,813, filed on Jun. 19, 2008, now Pat. No. 8,427,404.

(30) Foreign Application Priority Data

Dec. 20, 2005 (FR) ..... 05 53976
Dec. 19, 2006 (WO) ..... PCT/EP06/69922

(51) Int. Cl.
*G09G 3/32* (2006.01)

(52) U.S. Cl.
USPC ..... 345/82; 345/208

(58) Field of Classification Search
USPC ..... 345/204–209, 82–84, 87–100
See application file for complete search history.

(56) References Cited

U.S. PATENT DOCUMENTS

| | | | | |
|---|---|---|---|---|
| 6,177,965 | B1 | 1/2001 | Takahara et al. | |
| 2002/0154084 | A1 | 10/2002 | Tanaka et al. | |
| 2003/0107565 | A1 | 6/2003 | Libsch et al. | |
| 2003/0214249 | A1 | 11/2003 | Kaneko et al. | |
| 2004/0150591 | A1 | 8/2004 | Ozawa et al. | |
| 2004/0201581 | A1 | 10/2004 | Miyazawa | |
| 2005/0007357 | A1 * | 1/2005 | Yamashita et al. | 345/204 |
| 2006/0256058 | A1 | 11/2006 | Asano et al. | |

FOREIGN PATENT DOCUMENTS

| | | |
|---|---|---|
| JP | 7230075 | 8/1995 |
| JP | 2004004910 | 1/2004 |

* cited by examiner

*Primary Examiner* — Liliana Cerullo
(74) *Attorney, Agent, or Firm* — Robert D. Shedd; Jeffrey M. Navon

(57) ABSTRACT

The method comprises, in addition to emission periods, depolarization periods during which a predetermined depolarization voltage, which exhibits a polarity opposite to the polarity opposite to the voltage applied during the emission periods, is applied and sustained at the control terminal of said driver circuits of the panel, and a reference depolarization voltage, which is different from the reference emission voltage, is applied to the reference electrodes to which reference terminals of the driver circuits are linked. This method makes it possible to use conventional and inexpensive column control means.

11 Claims, 3 Drawing Sheets

METHOD OF DRIVING A DISPLAY PANEL WITH DEPOLARIZATION

Figure 1:
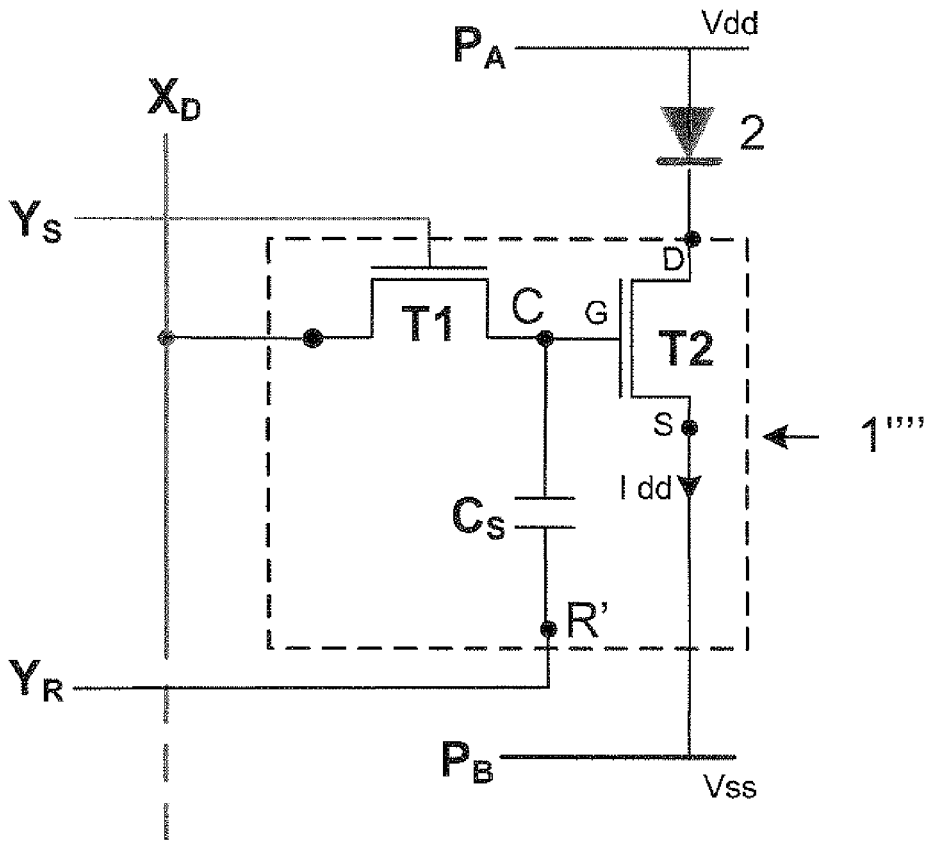

This application is a divisional of co-pending U.S. application Ser. No. 12/086,813, filed Jun. 19, 2008, herein incorporated by reference.

The invention relates to active matrix panels which can be used to display pictures using arrays of light emitters, for example light-emitting diodes, or arrays of optical valves, for example liquid crystal valves. These emitters or these valves are normally divided into rows and columns.

The term "active matrix" denotes a substrate which incorporates arrays of electrodes and circuits designed to control and power the emitters or optical valves supported by this substrate. These arrays of electrodes normally comprise at least one array of address electrodes, one array of select electrodes, at least one reference electrode for addressing and at least one base electrode for the power supply to these emitters. Sometimes, the reference electrode for addressing and the base electrode for the power supply are combined. The panel also comprises at least one upper power supply electrode, normally common to all the valves or all the emitters, but which is not incorporated in the active matrix. Each valve or emitter is normally inserted between a base power supply terminal linked to a base electrode for the power supply and the upper power supply electrode which normally covers all the panel.

Each driver circuit comprises a control terminal linked or coupled to an address electrode via a select switch, a select terminal which corresponds to the control of this switch and which is linked to a select electrode, and a reference terminal linked or coupled to a reference electrode.

Each driver circuit therefore comprises a select switch designed to transmit to this circuit the address signals originating from an address electrode. Closing the select switch of a circuit corresponds to selecting that circuit.

Normally, each address electrode is linked or coupled to the control terminals of the driver circuits of all the emitters or of all the valves of one and the same column; each select electrode is linked to the select terminals of the driver circuits of all the emitters or of all the valves of one and the same row. The active matrix can also comprise other row or column electrodes.

The address electrodes are used to address control signals to the driver circuits, analogue in voltage or in current mode, or digital; during the emission periods, each control signal intended for the driver circuit of a valve or of an emitter is representative of an image datum of a pixel or sub-pixel associated with that valve or that emitter.

In the case of a panel of optical valves, each driver and power supply circuit comprises a memory element, normally a capacitor, designed to sustain the control voltage of this valve for the duration of an image frame; this capacitor is connected in parallel directly across this valve; this capacitor can be formed by the valve itself. The control voltage of a valve is the potential difference at the terminals of that valve. In a particularly simple driver circuit case, the control terminal of the circuit is linked or coupled to one of the terminals of the valve. In the case of a panel of emitters that can be driven in current mode, for example light-emitting diodes, in particular organic diodes, each driver and power supply circuit generally comprises a current modulator, normally a TFT transistor, provided with two current passing terminals, one source terminal and one drain terminal, and a gate terminal for the voltage-mode control; this modulator is then connected in series with the emitter to be controlled, this series being in turn connected between an (upper) power supply electrode and a base electrode for the power supply; normally, it is the drain terminal that is common to the modulator and to the emitter, and the source terminal, linked to the base electrode for the power supply, is thus at a constant potential; the control voltage of the modulator is the potential difference between the gate and the source of the modulator; each driver circuit comprises means for generating a modulator control voltage as a function of the signal addressed to the control terminal of that circuit; each driver circuit also comprises, as previously, a sustain capacitor suitable for sustaining the control voltage of the modulator for the duration of each image or image frame. In a particularly simple driver circuit case, the control terminal of the circuit corresponds to the gate terminal of the modulator.

Conventionally, there are two types of control: voltage-mode control or current-mode control. In the case of a voltage-mode control, the address signals are voltage levels; in the case of current-mode control, the address signals are current levels.

In the case of current-mode driving of emitter panels, each driver circuit is designed in a manner known per se to "programme", from a current signal, a control voltage of the modulator of that circuit, which is then applied to the gate terminal; there are thus, conventionally, "current mirror" driver circuits.

The address electrodes and the select electrodes are themselves controlled by control means ("drivers") placed at the ends of these electrodes, at the edge of the panel; these means normally comprise controllable switches. To ensure a good image display quality and/or to increase the lifespan of the panel, it is important to regularly reverse the control voltage of the modulators of the driver circuits, and/or the power supply voltage of the valves or the emitters:

- in the case of panels of optical valves, in particular of liquid crystals, the voltage is normally alternated at the terminals of the valves to avoid initiating a DC liquid crystal polarization component;
- in the case of panels of light emitters, where the emitters are light-emitting diodes, it may be advantageous to regularly reverse the voltage at the terminals of the emitters, as described, for example, in documents EP1094438 and EP1197943; however, during the periods where this power supply voltage is reversed, these emitters obviously emit no light, the diodes then being reverse polarized;
- in the case of panels of current-mode drivable emitters, of which the driver circuits comprise a current modulator, where these modulators are transistors comprising active layers of amorphous silicon, it may be advantageous to regularly reverse the control voltage of the modulators, in particular to compensate for the drifts in the trigger threshold voltage of this type of transistor: documents US2003/052614, WO2005/071648 illustrate such a situation. When images are displayed, a distinction is then made, for each driver circuit, between display or emission periods, where the sign of this voltage is designed to render the modulator passing, and so-called depolarization periods, where the sign of this voltage is reversed and does not allow the modulator to be rendered passing. For the overall driving of the panel, the emission periods and the depolarization periods can overlap: while the emitters or valves of certain rows emit light, the circuits, emitters or valves of other rows can be being depolarized. Nevertheless, overall, alternating these periods is prejudicial to the maximum luminance of the panel, since the overall duration available for emission from the emitters is reduced by the duration of the depolarization periods.

Still in the case of panels of current-mode drivable emitters, in order to avoid this reduction in luminance, document WO2005/073948 proposes a panel where each emitter is provided with two driver circuits and is driven alternately by one and the other, which entails doubling the array of address electrodes. Other solutions conversely entail adding an array of row electrodes.

Document US2003/112205 describes a specific solution: by driving the driver circuit described in FIG. 6 as indicated in paragraphs 44 and 45 of this document, where a negative voltage Vee is applied to the reference address electrode (which is also the base electrode for the power supply), during the so-called "non-luminescence" periods, there is then obtained a reverse polarization at the terminals of the emitter (here, a light-emitting diode), and, during this reverse polarization, the control of the current modulator Tr2 which is in series with this emitter is cancelled (source and gate of this modulator are at the same potential because of the closing of the switch short-circuiting the sustain capacitor).

By using the solutions described in documents US2003/052614 and WO2005/071648, the control means of the address electrodes must then be designed to transmit address signals of opposite signs or polarities; the solution described in document US2003/052614 entails adding a "toggle" element at the head of each address electrode; this adaptation requirement adds a significant cost overhead in column "drivers".

One object of the invention is to avoid this drawback.

In the prior art, the address signals are normally transmitted to the driver circuits by direct conduction between the address electrodes and the control terminals of the circuits, via the select switch: in the case of voltage-mode analogue driving of emitter panels, where the control terminal of the circuit corresponds to the gate terminal of the modulator, this gate voltage of the modulator is then equal to the voltage of the address electrode which controls this circuit, at least while this circuit is selected.

Document U.S. Pat. No. 6,229,506 describes the case where these address signals are, on the contrary, transmitted to the driver circuits by capacitive coupling: in the case of voltage-mode driving (FIGS. 3 and 4 in this document), a coupling capacitance (respectively referenced 350 and 450) here provides the link without direct conduction between the address electrode and the control terminal of the circuit. When such a circuit is selected, this arrangement makes it possible to add the voltage skip signal originating from the address electrode to a trigger threshold voltage of the modulator, previously stored in the circuit. The link by capacitive coupling, and not by conduction, between the address electrodes and the control terminals of the circuits here makes it possible to compensate for the trigger threshold differences of the modulators of these circuits, so as to obtain a more uniform luminance on the screen and a better image display quality. For the same purpose, the other documents U.S. Pat. No. 6,777,888, U.S. Pat. No. 6,618,030, U.S. Pat. No. 6,885,029 describe a capacitive coupling between the address electrodes and the control of the current modulators of the emitters. Documents US2004/150591 and US2002/154084 describe the use of a capacitive coupling, via the sustain capacitor, between the reference electrodes and the control, either of emitter current modulators, or of optical valves, to drive an image display panel; according to these documents, appropriate variations of the reference potential applied to the reference electrodes make it possible to reduce the amplitude of the electroluminescent emitter address signals (US2004/150591: see abstract and paragraph 24) or increase the amplitude of the optical valve control signals (US2002/154084: see paragraph 10). Document U.S. Pat. No. 6,177,965 describes the same capacitive coupling with reference electrodes that are also used to supply power to the optical valves; the control signal applied to the optical valves, which changes polarity from one emission period to the next consecutive one, depends both on the signal applied to the address electrodes and the signal applied to the reference electrodes (see column 14, lines 14-21 and column 16, lines 41-64); it should be noted here that the address signal applied by the address electrodes also changes polarity from one emission period to a consecutive depolarization period (Vb and −Vb; Vp and Vn), and that, during the depolarization periods, the optical valves retain the same display function as during the so-called emission periods.

An essential aspect of the invention consists in using a capacitive coupling in order to reverse the voltages at the valve terminals or at the emitter terminals and/or the control voltages of the modulators of the driver circuits of these emitters, without having to reverse the address signals, which avoids having to use expensive address electrode control means. Thus, according to the invention, the voltage signal which is transmitted by capacitive coupling is in particular a reference voltage skip for addressing the driver circuits, in particular of one and the same row. By an appropriate change of reference, it is possible, as described below, to address address signals of the same polarity in the emission periods and in the depolarization periods of driver circuits of an emitter or of a valve, in particular of one and the same row. It should be noted that, even if documents US2004/150591 and US2002/154084 teach the use of such a capacitive coupling to reduce the amplitude of the address signals or to increase the amplitude of the control signals, there is nothing to urge those skilled in the art to use this same means and, furthermore, to address address signals still of the same polarity, in order to limit the cost of the column drivers and avoid the costly solutions described in documents US2003/052614, WO2005/071648 and US2003/052614 cited above when the desire is, when driving a display panel, to periodically reverse the voltages at the optical valve terminals or at the light emitter terminals, and/or the control voltages of the modulators of the driver circuits of these emitters. No document of the prior art, whether or not included in the general knowledge of those skilled in the art, explicitly indicates that, to reduce the cost of the driver circuits of a display panel, it is preferable to mutually adjust the reference and address voltages in order to use an address generator with a single polarity, this address generator possibly also being used to supply energy, particularly in the case of panels of optical valves.

As a general rule, capacitive coupling makes it possible to modify the voltage of a terminal by a voltage skip. In the case of a capacitive coupling according to the invention between a reference terminal of a circuit and its control terminal, any algebraic offset $\Delta V$ of the reference voltage applied to this terminal is then transmitted by this capacitive coupling to the control terminal of the circuit, independently of the initial voltage or of the signal previously addressed to that control terminal.

In the embodiments described below, the driving of each driver circuit of an emitter comprises, when displaying each image or image frame, two periods, a period of emission from this emitter and a period of depolarization of the modulator of the driver circuit of this emitter during which this emitter does not emit light.

In the general modality of the invention, the panel comprises a reference electrode specific to each row of emitters or valves; instead, as in document US2003/052614 cited above, of adding at the head of each address electrode of a column, a toggle switch between a column address terminal, designed to transmit display control signals to the circuits of this column, and a column depolarization terminal raised to a depolarization potential, there is added at the head of each reference electrode of a row, a toggle switch between a first row reference terminal for emission, at the potential $V_{ref-E}$, and a second row reference terminal for depolarization, raised to the potential $V_{ref-P}$.

In the driver circuits of this panel, the sustain capacitor is connected conventionally between the control of the modulator and the reference terminal of the circuit.

By using a conventional emitter driver circuit, after a conventional emission period for driving the driver circuit of an emitter, the depolarization period proceeds as follows:

1/ the reference terminal of this circuit being sustained, as throughout the preceding emission period, at the reference emission potential $V_{ref-E}$, the circuit is selected by coupling the control terminal to an address electrode; during this selection, a depolarization signal is addressed in a conventional manner to the control terminal of this circuit so as to generate at this terminal a potential $V_{pol}$;

2/ the circuit no longer being selected (control terminal decoupled from the address electrode), the reference terminal for addressing this circuit is then raised to the reference depolarization potential $V_{ref-P}$, which leads, by capacitive coupling via the sustain capacitor of this circuit, to a voltage skip, that is, a reference offset, at the control terminal of this circuit which changes from the potential $V_{pol}$ to the potential $V_{prog-pol}=V_{pol}+\Delta V_{prog-0}$, where $\Delta V_{prog-0}=V_{ref-P}-V_{ref-E}$.

During the rest of the current depolarization period, the reference terminal of the circuit is sustained at the same potential $V_{ref-P}$, and the potential of the control terminal is sustained at the value $V_{prog-pol}$ by the sustain capacitor. According to the invention, in the voltage reversal or depolarization periods, the value of $V_{ref-P}$ is then adapted so that, regardless of the address signal for depolarization $V_{pol}$ addressed to the control terminal of the circuit to obtain, after offsetting the reference, at this same terminal which corresponds in particular to the control of a current modulator, a potential $V_{prog-pol}$ designed to depolarize this modulator, this address signal for depolarization is of the same sign as the address signals for emission addressed to this circuit during the emission periods. Thus, advantageously, the need for costly address electrode control means is avoided.

The address signals are normally transmitted by conduction between the address electrodes and the control terminals of the circuits, although a capacitive transmission mode is also possible as described in the prior art cited above.

One advantage of the invention is that it is applicable to very simple driver circuits, particularly those that have only two transistors. Another advantage of the invention is that it makes it possible to address a specific depolarization signal $V_{pol}$ to each circuit, and to adapt the depolarization operation to the polarization level of the modulator of each circuit, a level that depends in particular on the emission signal addressed during the preceding emission period.

The subject of the invention is therefore a method of driving a display panel which comprises:

an array of light emitters or optical valves, an active matrix comprising an array of electrodes for voltage-mode signal addressing, an array of select electrodes, an array of reference electrodes, an array of circuits suitable for controlling each of said emitters or valves and each provided with a control terminal suitable to be coupled to an address electrode via a select switch, a reference terminal linked to a reference electrode, and a sustain capacitor mounted between said control terminal and said reference terminal, the control of said select switch being linked to a select electrode, said method comprising:

emission periods during which a predetermined emission voltage $V_{prog-data}$, which presents a first polarity, is applied and sustained at the control terminal of at least one driver circuit of said panel, and a reference emission voltage $V_{ref-E}$ is applied to the reference electrodes to which the reference terminals of these circuits are linked, and depolarization periods during which a predetermined depolarization voltage $V_{prog-pol}$, which presents a second polarity, opposite to the first polarity, is applied and sustained at the control terminal of at least one driver circuit of said panel, and a reference depolarization voltage $V_{ref-P}$ is applied to the reference electrodes to which the reference terminals of these circuits are linked, where said reference depolarization voltage $V_{ref-P}$ is different from said reference emission voltage $V_{ref-E}$.

The emitters or valves are designed to be powered between at least two power supply electrodes, namely a base electrode for the power supply which is normally part of the active matrix, and a so-called "upper" power supply electrode, which normally covers all the emitters or valves.

The sustain capacitor is designed to sustain a voltage that is approximately constant on said control terminal for the duration of an image when said select switch is open.

In practice, during emission or depolarization periods, a predetermined emission or depolarization voltage is normally applied and sustained at the control terminal of each of said driver circuits of said panel.

Thanks to different reference voltages $V_{ref-E}$, $V_{ref-P}$ in the emission periods and in the depolarization periods, if an address signal $V_{addr}$ is applied to an address electrode coupled to the control terminal of a driver circuit of the panel while the reference emission voltage $V_{ref-E}$ is applied to the reference terminal of this circuit and generates on this control terminal an emission voltage $V_{prog-addr}$, this same address signal $V_{addr}$ which would be applied to this address electrode while the reference depolarization voltage $V_{ref-P}$ is applied to the reference terminal R' would generate on the control terminal a depolarization voltage $V'_{prog-addr}$ offset by the value $\Delta V_{prog-0}=V_{ref-P}-V_{ref-E}$ relative to the emission voltage $V_{prog-addr}$; this offset originates from the capacitive coupling between the control terminal and the reference terminal of the circuit.

When the select switch of a driver circuit is closed, the coupling between the control terminal of this circuit and an address electrode is preferably produced by conduction; according to a variant, this coupling is produced capacitively.

The driving of the panel is normally intended for the display of a succession (or sequence) of images; each emitter or valve of the panel then has a corresponding pixel or sub-pixel of the images to be displayed; during each emission period, each emitter or valve of the panel has associated with it a predetermined emission voltage to control this emitter or valve, this voltage being designed to obtain the display of said pixel or sub-pixel by this emitter or valve; during each depolarization period, each emitter or valve of the panel has associated with it a predetermined depolarization voltage designed to depolarize this emitter, this valve and/or its driver circuit.

Thus, the predetermined voltage to be applied and to be sustained at the control terminal of the driver circuits of said panel is intended:

for the emitter or the valve of the panel that is controlled by this circuit to emit a pixel or sub-pixel of the image to be displayed, and/or for the emitter or the valve of the panel, or the driver circuit, or, where appropriate, the current modulator of this circuit, to be depolarized, at least partially.

Preferably, each period, whether of emission or depolarization, comprises, to obtain said predetermined voltage $V_{prog\text{-}data}$ $V_{prog\text{-}pol}$ at the control terminal of a circuit, an addressing step during which a select signal is applied to the control of the select switch which couples said control terminal to an address electrode, and an address signal $V_{data}$, $V_{pol}$, which is adapted to obtain said predetermined voltage $V_{prog\text{-}data}$, $V_{prog\text{-}pol}$ at said control terminal, is applied to this address electrode, and, as of the end of the select signal, a sustain step during which said predetermined voltage $V_{prog\text{-}data}$, $V_{prog\text{-}pol}$ is sustained at the control terminal by said sustain capacitor.

In this case, preferably, each depolarization period during which an address signal $V_{pol}$ is sent to an address electrode coupled to the control terminal of a circuit, also comprises a reference de-setting step, inserted between the addressing step and the sustain step of this period, during which the voltage applied to the reference terminal of this circuit changes from the reference emission voltage $V_{ref\text{-}E}$ to the reference depolarization voltage $V_{ref\text{-}P}$, and a reference re-setting step, after said sustain step, during which the voltage applied to the reference terminal of this circuit changes from the reference depolarization voltage $V_{ref\text{-}P}$ to the reference emission voltage $V_{ref\text{-}E}$. The reference re-setting step preferably takes place before the addressing step of the emission period that follows this depolarization period; according to a variant, this re-setting step is, on the contrary, inserted between the addressing step and the sustain step of this emission period.

Still in this case, preferably, said reference emission voltage $V_{ref\text{-}E}$ and said reference depolarization voltage $V_{ref\text{-}P}$ are chosen such that said address signal $V_{data}$, $V_{pol}$ presents the same polarity regardless of said period, whether it is of emission or depolarization. Thus, the voltage of the address electrode never changes sign, always presents the same polarity, and it is advantageously possible to use conventional and inexpensive means to control the address electrodes. The polarity of the signals is evaluated relative to a reference electrode for the control voltage of the circuits; it can, in particular, be a base electrode for the power supply to the emitters or the valves.

In practice, for example for a depolarization period and a predetermined depolarization voltage $V_{prog\text{-}pol}$ to be applied to the control terminal of a driver circuit, the difference $\Delta V_{prog\text{-}0}=V_{ref\text{-}P}-V_{ref\text{-}E}$ is first chosen so that the address signal $V_{pol}=V_{prog\text{-}pol}-\Delta V_{prog\text{-}0}$ to be sent to the address electrode to obtain this predetermined voltage $V_{prog\text{-}pol}$ presents the same polarity as the address signals $V_{data}$ that are used during the emission periods; from this difference $\Delta V_{prog\text{-}0}$, the value of $V_{ref\text{-}P}$ is deduced.

According to a variant, said reference electrodes are grouped in g groups, and all the reference electrodes of each group are linked to one and the same common reference terminal. If the emitters or valves of the panel are distributed in m rows and in n columns, such a variant then makes it possible advantageously to proceed simultaneously with the depolarization of all the circuits for which the reference terminal is linked to the reference electrodes of one and the same group, while the other circuits remain available to control emission. The panel is, for example, divided up into g groups of q rows, where g×q is equal to the total number m of rows; all the reference electrodes of one and the same group are interlinked; the number of reference row toggle switches is then limited to g; such a variant is advantageous in particular when the duration required to obtain an effective depolarization of a modulator is far less than the emission duration during which this modulator is polarized; in practice, the modulators of the driver circuits of the rows of a single group are then depolarized while the emitters of the (g−1) other groups are in the emission period; thus, the time available for emission is optimized, which makes it possible to improve the luminance of the panel.

According to a preferential embodiment of this variant, said emitters or valves of the panel are distributed in m rows, and said reference electrodes are grouped in two groups (g=2), one group of reference electrodes ($Y_R$) corresponding to the odd rows and one group of reference electrodes ($Y_R$) corresponding to the even rows. Preferably, then, the driving method according to the invention is then advantageously intended to display interleaved images, each divided between an odd frame of image data relating to the pixels or sub-pixels of the odd rows of this image, and an even frame of image data relating to the pixels or sub-pixels of the even rows of this image; each emitter or valve of the panel is associated with a pixel or a sub-pixel of the images to be displayed; each emission period of an image is subdivided between an odd frame emission period where the reference electrodes corresponding to the odd rows are raised to said reference emission voltage $V_{ref\text{-}E}$ and an even frame emission period where the reference electrodes corresponding to the even rows are raised to said reference emission voltage $V_{ref\text{-}E}$; each depolarization period is also subdivided between an odd frame depolarization period where the reference electrodes corresponding to the odd rows are raised to said reference depolarization voltage $V_{ref\text{-}P}$ and an even frame depolarization period where the reference electrodes corresponding to the even rows are raised to said reference depolarization voltage $V_{ref\text{-}P}$; and each odd frame emission period coincides with an even frame depolarization period, and each even frame emission period coincides with an odd frame depolarization period. Advantageously then, the staggering of the images in sub-frames is exploited to depolarize the emitters, the valves or their driver circuits while they are not required for emission. The depolarization thus takes place with no loss of light efficiency, since the depolarization takes place in masked time. This variant of the invention also makes it possible to simplify the active matrix of the panel; according to this variant, the even rows of the panel share one and the same first reference electrode and the odd rows of the panel share one and the same second reference electrode, these reference electrodes covering all the panel and being implemented in different planes, slightly offset, of the active matrix; advantageously, there are then no more than two toggle switches.

Preferably, said panel comprises an array of light emitters suitable to be powered between at least one power supply base electrode $P_B$ and at least one upper power supply electrode $P_A$, and each of said driver circuits of an emitter comprises a current modulator comprising a voltage-mode control electrode forming the control electrode of said circuit and two current-passing electrodes, which are connected between one of said power supply electrodes and a power supply electrode of said emitter. Normally, such a modulator is a TFT transistor; the current delivered by the modulator is then a function of the potential difference between the gate terminal and the source terminal of this transistor; this potential difference is normally a function of, if not equal to, the potential difference between the control terminal and a reference electrode for the control voltage of the circuit; the reference electrode for the control voltage of the circuit is then formed by the power supply base electrode.

Preferably, said current modulator is a transistor comprising a semiconductor layer of amorphous silicon.

Preferably, said emitters are light-emitting diodes, preferably organic.

Figure 2:
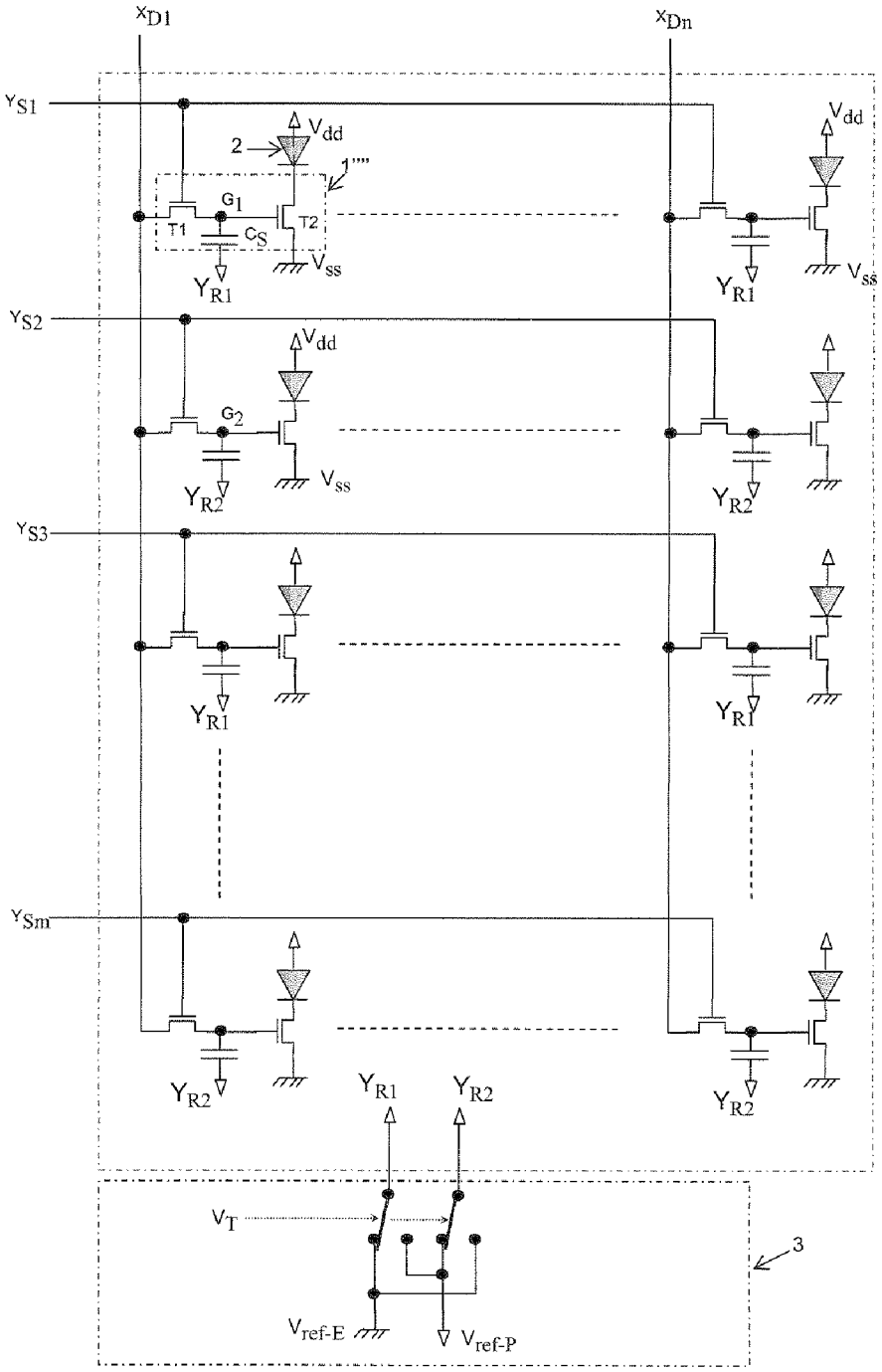
Figure 3:
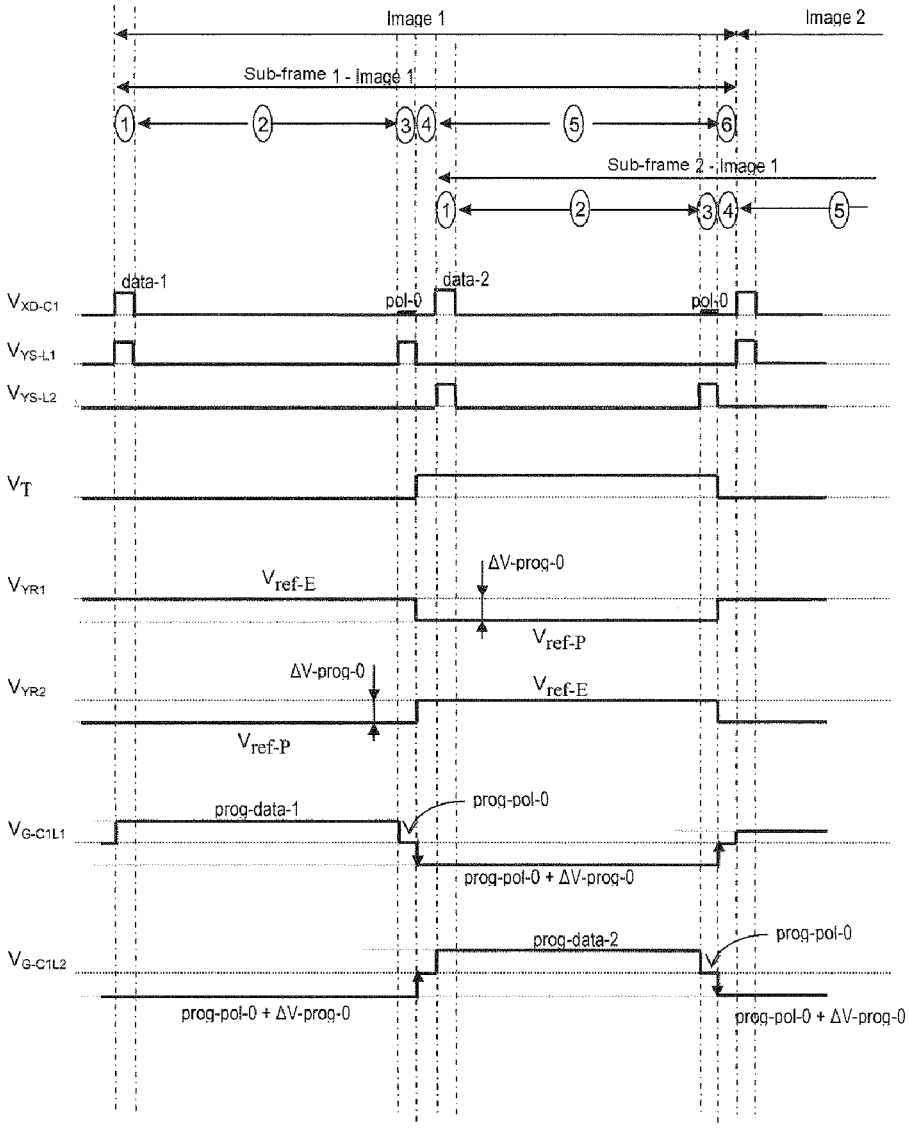

The invention will be better understood from reading the description that follows, given by way of nonlimiting example, and with reference to the appended figures in which:

FIG. 1 describes an embodiment of a driver circuit for a panel according to a first embodiment of the invention;

FIG. 2 describes a second embodiment of the invention, which is a variant of the first embodiment;

FIG. 3 is a timing diagram of the signals applied during a succession of periods and frames for the control of the circuits of the panel of FIG. 2 when driving this panel according to the invention (address signals $V_{XD-C1}$ of the address electrode of the first column, logic select signals $V_{YS-L1}$, $V_{YS-L2}$ for respectively the first and the second row, logic control signal for the toggle switch $V_T$); this timing diagram also illustrates, respectively, the trend of the potential $V_{YR1}$, $V_{YR2}$ of the reference electrode $Y_{R1}$, $Y_{R2}$ and the trend of the control potential $V_{G-C1L1}$, $V_{G-C1L2}$ of the modulator, respectively of the circuit of the first column and of the first row, and of the circuit of the first column and of the second row.

The figures representing the timing diagrams do not take account of the scale of values in order to better show certain details which would not be clearly apparent if the proportions were respected. In order to simplify the description, identical references are used for elements that provide the same functions.

The embodiments described below relate to image display panels where the emitters are organic light-emitting diodes deposited on an active matrix incorporating driver and power supply circuits for these diodes. These emitters are arranged in rows and columns.

There now follows a description of a first embodiment of the invention.

With reference to FIG. 1, the panel here comprises a single array of select electrodes $Y_S$; it comprises one reference electrode for each row; there is therefore an array of reference electrodes $Y_R$; each reference electrode $Y_R$ serves all the driver circuits of one and the same row; the panel also comprises control means of the reference electrodes, which are designed to toggle the potential of these electrodes between a reference potential for emission $V_{ref-E}$ and a reference potential for depolarization $V_{ref-P}$. Here $V_{ref-P} \ll V_{ref-E}$; these means normally comprise toggle switches (not shown).

The panel also comprises:

- an array of address electrodes arranged in columns so that all the circuits controlling the diodes of one and the same column are served by the same address electrode $X_D$;
- a power supply base electrode $P_B$ common to all the circuits;
- an upper power supply electrode $P_A$, common to all the diodes.

The active matrix also comprises a driver and power supply circuit 1"" for each diode 2. Still with reference to FIG. 1, each circuit 1"" comprises:

- a current modulator T2 comprising two current terminals, namely a drain terminal D and a source terminal S, and a gate terminal G, which here corresponds to the control terminal C of the circuit.
- a sustain capacitor $C_S$ connected between the control terminal C of the circuit and a reference terminal R' of the circuit.

The control terminal C of the circuit is linked to an address electrode $X_D$ via a select switch T1, which corresponds to a "conductive" coupling between this terminal and this electrode; in this embodiment, there is no capacitive coupling on addressing. It will be seen later how the capacitive coupling here takes place between the reference terminal R' of the circuit and the control terminal C of the circuit. The select switch T1 is controlled by a select electrode Y. The reference terminal R' is linked to the reference electrode $Y_R$ of the row.

The current modulator T2 is linked in series with the diode 2: the drain terminal D is thus connected to the cathode of the diode 2. This series is connected between two power supply electrodes: the source terminal S is connected to the power supply base electrode $P_B$ and the anode of the diode 2 is connected to the upper power supply electrode $P_A$.

Each circuit 1"" therefore comprises only two TFT transistors.

There now follows a description of how the panel operates according to this first embodiment.

The potentials Vdd and Vss are applied respectively to the power supply electrodes $P_A$ and $P_B$. The difference Vdd-Vss is designed to obtain emission from the diode when the control of the modulator is greater than its trigger threshold voltage.

As in the prior art cited previously, on each diode of the panel and its driver circuit, each image or image frame is broken down into an emission period from this diode for the display and a depolarization period to compensate for the drift in the threshold of the modulator of this circuit.

To control each driver circuit 1"" of a diode 2, the driving of this circuit during each image frame is then subdivided into six steps.

Step 1, Addressing for Emission:

The potential of the reference electrode $Y_R$ to which the reference terminal R' of the circuit 1"" is linked having previously been raised to the value $V_{ref-E}$, the select switch T1 is closed by applying to the select electrode $Y_S$ an appropriate logic signal; closing T1 causes the circuit to be selected by linking the control terminal C to the address electrode $X_D$; during this step, the potential of the address electrode is raised to the value $V_{data-1}$ so that the potential of the control terminal C takes the value $V_{prog-data-1}$, here equal to $V_{data-1}$ since the coupling is "conductive" between this terminal and this electrode. The duration of this step is long enough to charge the sustain capacitor $C_S$; the diode 2 therefore begins to emit a luminance proportional to the image datum of the pixel or sub-pixel that is associated with it during this image frame.

Step 2, Sustaining the Circuit During the Emission Period:

During the rest of the emission period from this diode 2 during this image frame, the select switch T1 remains open; the driver circuit 1"" is therefore no longer selected. During this step, the capacitor $C_S$ sustains at a constant value the voltage of the control terminal C, and the diode 2 therefore continues to emit a luminance proportional to the image datum of the pixel or sub-pixel that is associated with it.

During this step 2, the driver circuits of the other rows of diodes are selected by addressing to the control terminals of these circuits the address signals designed to display all the image.

Step 3, Addressing for Depolarization (or Clearing):

The potential of the reference electrode $Y_R$ to which the reference terminal R' of the circuit 1"" is linked still being at the value $V_{ref\text{-}E}$, the select switch T1 is closed by applying to the select electrode $Y_S$ an appropriate logic signal; closing T1 causes the circuit to be selected again by linking the control terminal C to the address electrode $X_D$; during this step, the potential of the address electrode is raised to the value $V_{pol\text{-}1}$ so that the potential of the control terminal takes the value $V_{pol\text{-}1}$. The duration of this step is long enough to charge the sustain capacitor $C_S$ but short enough to prevent if not limit the emission from the diode 2.

Step 4, De-Setting the Reference: Changing to the Depolarization Reference, by Capacitive Coupling:

The select switch T1 is opened by applying to the select electrode $Y_S$ an appropriate logic signal; opening T1 causes the control terminal C to be decoupled from the address electrode $X_D$.

The reference electrode $Y_R$ to which the terminal R' of this circuit is linked is then raised to the reference potential for depolarization $V_{ref\ P}$, which causes, by capacitive coupling between this reference terminal R' and the control terminal C, the potential of this control terminal C to be offset by the value (negative in this case) $\Delta V_{prog\text{-}C}=V_{ref\text{-}P}-V_{ref\text{-}E}$; the potential of this control terminal C then changes from the value $V_{pol\text{-}1}$ to the value $V_{pol\text{-}1}+\Delta V_{prog\text{-}0}=V_{prog\text{-}pol\text{-}1}$. At this stage, the modulator T2 begins to be depolarized in proportion to the value of $V_{prog\text{-}pol\text{-}1}$.

Step 5, Sustaining the Circuit during the Depolarization Period:

During the rest of the depolarization period of the modulator of this diode 2 during this image frame, the select switch T1 remains open. During this step, the capacitor $C_S$ sustains at a constant value the voltage of the control terminal C, and the modulator T2 therefore continues to be depolarized. During this step 2, the driver circuits of the other rows of diodes are selected by addressing to the control terminals of these circuits the address signals designed to depolarize the modulators of all the driver circuits.

Step 6, Re-Setting the Reference: Restoring to the Emission Reference, by Capacitive Coupling:

The select switch T1 still being open, the reference electrode $Y_R$ to which the terminal R' of this circuit is linked is then raised to the reference potential for emission $V_{ref\text{-}E}$, which causes, by capacitive coupling between this reference terminal and the control terminal C, the potential of this control terminal C to be restored to the value $V_{pol\text{-}1}$ applicable at the end of the step 3.

The circuit is then ready for a new addressing step 1 for the emission of a new image.

According to the invention, the value of $V_{ref\text{-}P}$ is adapted so that, whatever the depolarization signal $V_{pol\text{-}1}$ addressed to the control of the circuit via the address electrode, this depolarization signal is of the same sign as the emission signals $V_{data\text{-}1}$ addressed to this circuit during the emission periods. Thus, advantageously, the need for costly address electrode control means is avoided.

Preferably, in order to prevent the diodes from emitting light during the addressing steps 3 for depolarization where the reference terminal R' is again at the reference potential for emission, address signal values are chosen for depolarization such that the control voltage $V_G$-$V_S$ of the modulator T2 is less than the trigger threshold voltage $V_{th}$ of this modulator; therefore, $V_{pol\text{-}i}$ is chosen such that $V_{prog\text{-}pol\text{-}i}-Vss<V_{th}$. If $V_{pol\text{-}0}$ is the address signal value that generates a potential $V_{prog\text{-}pol\text{-}0}$ at the gate G such that $V_{prog\text{-}pol\text{-}0}=Vss$, $V_{pol\text{-}i}$ is preferably chosen to be constant and equal to $V_{pol\text{-}0}$.

There now follows a description of a second embodiment of the invention, implemented according to this preference $V_{pol\text{-}i}=V_{pol\text{-}0}$ and $V_{prog\text{-}pol\text{-}0}=Vss$. The panel according to this variant is illustrated in FIG. 2; this panel comprises an even number m of rows and n columns.

According to this variant, the array of reference electrodes comprises only two electrodes $Y_{R1}$ and $Y_{R2}$. These electrodes are incorporated in the active matrix of the panel. Preferably, each electrode $Y_{R1}$ and $Y_{R2}$ forms a continuous conductive plane, offset relative to each other.

The reference terminals R' of the driver circuits of the odd rows of emitters are all linked to the same reference electrode $Y_{R1}$; the reference terminals R' of the driver circuits of the even rows of emitters are all linked to the same reference electrode $Y_{R2}$.

The panel comprises a single toggle switch 3, designed to:

either raise the potential of the first reference electrode $Y_{R1}$ to the potential $V_{ref\text{-}E}$ and the potential of the second reference electrode $Y_{R2}$ to the potential $V_{ref\text{-}P}$;

or raise the potential of the first reference electrode $Y_{R1}$ to the potential $V_{ref\text{-}P}$ and the potential of the second reference electrode $Y_{R2}$ to the potential $V_{ref\text{-}E}$.

In FIG. 2, the select electrodes $Y_{S1}, Y_{S2}, \ldots, Y_{Sm}$ correspond to the rows L1, L2, . . . , Lm of the panel; the address electrodes $XD_1, XD_2, \ldots, XD_n$, correspond to the columns C1, C2, . . . , Cn.

With reference to FIG. 3, there now follows a description of a method of driving the panel according to this second embodiment.

According to this driving method, we therefore have $V_{pol\text{-}i}=V_{pol\text{-}0}$ and $V_{prog\text{-}pol\text{-}0}=Vss$.

According to this driving method, the image frames are interleaved, each image is divided into two frames: a frame of odd rows and a frame of even rows; in each frame, driving the panel comprises the steps 1 to 6 described previously.

Since the depolarization address signals $V_{pol\text{-}0}$ are identical for all the circuits of the panel, in the step 3, all the rows L1, L2, . . . , Lm of the panel are selected using an appropriate logic signal transmitted by the corresponding select electrodes $Y_{S1}, Y_{S2}, \ldots, Y_{Sm}$, and the same address signal is sent to the address electrodes $X_{D1}, X_{D2}, X_{Dn}$ of the columns C1, C2, . . . , Cn. The step 3 is therefore particularly short.

Preferably, as illustrated in FIG. 3, each step 4 (change of reference) of a frame is made to coincide with a step 6 (restoring the reference for emission) of the preceding frame; the frames are therefore interleaved.

Thus, for the step 4 of an even row which corresponds to the step 6 of an odd row, using the toggle switch 3 of the reference electrodes, the potential of the first reference electrode $Y_{R1}$ is raised to the potential $V_{ref\text{-}E}$ and the potential of the second reference electrode $Y_{R2}$ is raised to the potential $V_{ref\text{-}P}$. Similarly, for the step 4 of an odd row which corresponds to the step 6 of an even row, using the toggle switch 3 of the reference electrodes, the potential of the first reference electrode $Y_{R1}$ is raised to the potential $V_{ref\text{-}P}$ and the potential of the second reference electrode $Y_{R2}$ is raised to the potential $V_{ref\text{-}E}$.

It can therefore be seen that, according to this driving method, the odd rows and the even rows of the panel are addressed in emission mode (step 1 above) in turn. According to the invention, the value of $V_{ref\text{-}P}$ is chosen (negative) so as to optimize the depolarization common to all the modulators of the panel.

Advantageously, this embodiment is particularly cost-effective since it requires only one additional reference electrode and a single toggle switch compared to a panel without depolarization means, while using conventional column electrode control means, since it allows driving with address signals that are all of the same sign.

The embodiments described above relate to display panels with active matrix organic light-emitting diodes; the invention applies more generally to all sorts of active matrix display panels, in particular to emitters that can be driven in current mode or to optical valves.

The invention claimed is:

1. Method of driving a display panel which comprises;

an array of multiple light emitters or optical valves distributed in a plurality of rows and columns, an active matrix comprising an array of multiple address electrodes for voltage-mode signal addressing, an array of multiple select electrodes, an array of multiple reference electrodes, an array of multiple driver circuits suitable for controlling each of said emitters or valves and each provided with a control terminal suitable to be coupled to an address electrode via a select switch, a power supply base electrode common to all multiple driver circuits, and an upper power supply electrode common to all said light emitters or optical valves, a control of said select switch being coupled to a select electrode of the multiple select electrodes, said method comprising:

emission periods during which a predetermined emission voltage, which presents a first polarity, is applied and sustained at the control terminal of at least one driver circuit of said panel, and a reference emission voltage is applied to a reference electrode to which a reference terminal of the at least one driver circuit is coupled, and depolarization periods during which a predetermined depolarization voltage, which presents a second polarity, opposite to the first polarity, is applied and sustained at the control terminal of the at least one driver circuit of said panel, and a reference depolarization voltage is applied to the reference electrode to which the reference terminal of the at least one driver circuit is coupled, each of said emission or depolarization periods comprising, to obtain the predetermined emission voltage or depolarization voltage at the control terminal of each driver circuit, an addressing step during which a select signal is applied to the control of the select switch which couples the control terminal of this driver circuit to the address electrode, and an address signal, which is adapted to obtain said predetermined depolarization voltage or said predetermined emission voltage at said control terminal, is applied to this address electrode, wherein:

said reference depolarization voltage is different from said reference emission voltage, said reference emission voltage and said reference depolarization voltage are chosen such that said address signal presents the same polarity regardless of said emission or depolarization period.

2. Method according to claim 1, wherein the array of multiple light emitters or optical valves is an array of light emitters.

3. Method according to claim 2, wherein, during the depolarization periods of the driver circuits of the panel, the emitters controlled by these driver circuits do not emit light.

4. Method according to claim 1, wherein, the addressing step of a depolarization period also comprises:

as of the end of the select signal, a sustain step during which said predetermined depolarization voltage is sustained at the control terminal by a sustain capacitor, a reference de-setting step, inserted between the addressing step and the sustain step of this depolarization period, during which the voltage applied to the reference terminal of the at least one driver circuit changes from the reference emission voltage to the reference depolarization voltage, and reference re-setting step, after said sustain step, during which the voltage applied to the reference terminal of the at least one driver circuit this driver circuit changes from the reference depolarization voltage to the reference emission voltage.

5. Method according to claim 1, wherein, said reference electrodes are grouped in a plurality of groups, all the reference electrodes of each group are linked to one and the same common reference terminal.

6. Method according to claim 5, wherein, said emitters or valves of the panel are distributed in a plurality of rows, said reference electrodes are grouped in two groups, one group of reference electrodes corresponding to odd rows and one group of reference electrodes corresponding to even rows.

7. Method of driving a display panel according to claim 6, intended to display interleaved images, each divided between an odd frame of image data relating to pixels or sub-pixels of the odd rows of this image, and an even frame of image data relating to pixels or sub-pixels of the even rows of this image, where each emitter or valve of the panel is associated with one of the pixels or sub-pixels of the images to be displayed, wherein, each emission period of an image being subdivided between an odd frame emission period where the reference electrodes corresponding to the odd rows are raised to said reference emission voltage and an even frame emission period where the reference electrodes corresponding to the even rows are raised to said reference emission voltage, each depolarization period is also subdivided between an odd frame depolarization period where the reference electrodes corresponding to the odd rows are raised to said reference depolarization voltage and an even frame depolarization period where the reference electrodes corresponding to the even rows are raised to said reference depolarization voltage, and in that each odd frame emission period coincides with an even frame depolarization period, and each even frame emission period coincides with an odd frame depolarization period.

8. Method according to claim 1, wherein said panel comprising an array of light emitters suitable to be powered between the power supply base electrode and the upper power supply electrode, each of said driver circuits of an emitter comprises a current modulator comprising a voltage-mode control electrode forming the control electrode of said circuit and two current-passing electrodes, which are connected between the power supply base electrode and the upper power supply electrode, and an electrode of said emitter.

9. Method according to claim 8, wherein said current modulator is a transistor comprising a semiconductor layer of amorphous silicon.

10. Method according to claim 8, wherein said emitters are light-emitting diodes.

11. A display panel comprising;

an array of multiple light emitters or optical valves distributed in a plurality of rows and columns, an active matrix comprising an array of multiple address electrodes for voltage-mode signal addressing, an array of multiple select electrodes, an array of multiple reference electrodes, an array of multiple driver circuits suitable for controlling each of said emitters or valves and each provided with a control terminal suitable to be coupled to an address electrode via a select switch, a reference terminal coupled to a reference electrode, a sustain capacitor mounted between said control terminal and said reference terminal, a power supply base electrode common to all multiple driver circuits, and an upper power supply electrode common to all said light emitters or optical valves, the control of said select switch being coupled to a select electrode, wherein during emission periods a predetermined emission voltage, which presents a first polarity, is applied and sustained at the control terminal of at least one driver circuit of said panel, and a reference emission voltage is applied to a reference electrode to which the reference terminal of the at least one driver circuit is coupled, during depolarization periods a predetermined depolarization voltage, which presents a second polarity, opposite to the first polarity, is applied and sustained at the control terminal of the at least one driver circuit of said panel, and a reference depolarization voltage is applied to the reference electrode to which the reference terminal of the at least one driver circuit is coupled, each of said emission or depolarization periods comprising, to obtain a predetermined emission voltage or depolarization voltage at the control terminal of each driver circuit, an addressing step during which a select signal is applied to the control of the select switch which couples the control terminal of this driver circuit to the address electrode, and an address signal, which is adapted to obtain said predetermined depolarization voltage or said predetermined emission voltage at said control terminal, is applied to this address electrode, and wherein:

said reference depolarization voltage is different from said reference emission voltage, said reference emission voltage and said reference depolarization voltage are chosen such that said address signal presents the same polarity regardless of said emission or depolarization period.

* * * * *